US005131122A

United States Patent [19]

Lavato

[11] Patent Number: 5,131,122

[45] Date of Patent: Jul. 21, 1992

[54] RELEASABLE TWO-PART BUCKLE

[75] Inventor: Attilio Lovato, Pino Torinese, Italy

[73] Assignee: ITW Fastex Italia S.p.A., Strada Settimo, Italy

[21] Appl. No.: 727,813

[22] Filed: Jul. 8, 1991

[30] Foreign Application Priority Data

Jul. 10, 1990 [IT] Italy ..... 53138/90[U]

[51] Int. Cl.[5] ..... A44B 11/25

[52] U.S. Cl. ..... 24/625; 24/616; 24/635

[58] Field of Search ..... 24/625, 616, 615, 617, 24/618, 621, 606, 635, 587

[56] References Cited

U.S. PATENT DOCUMENTS

| | | | |
|---|---|---|---|
| 4,639,982 | 2/1987 | Kasai | 24/616 |
| 4,688,337 | 8/1987 | Dillner et al. | 24/615 |
| 4,809,409 | 3/1989 | Van Riesen | 24/635 |
| 4,949,436 | 8/1990 | Anscher | 24/616 |

FOREIGN PATENT DOCUMENTS

| | | | |
|---|---|---|---|
| 2635652 | 3/1990 | France | 24/615 |

*Primary Examiner*—Victor N. Sakran
*Attorney, Agent, or Firm*—Schwartz & Weinrieb

[57] ABSTRACT

A releasable buckle is described, made of molded synthetic plastic material and comprising a female part and a male part which snap-engages into a socket defined within the female part by means of a pair of longitudinal resilient arms provided with teeth which lock the buckle by cooperating with respective edges of a pair of lateral through slots formed within the female part. The male part is further provided with a central rigid arm cooperating with guide means of the socket within the female part and adapted to limit, in use, the deflection of the resilient arms. This rigid arm has a length such as to cooperate in an interfering manner when the teeth are in the engaged position within the slots, with resilient means provided upon a bottom wall of the socket of female part.

10 Claims, 3 Drawing Sheets

RELEASABLE TWO-PART BUCKLE

FIELD OF THE INVENTION

The present invention relates to a releasable two-part buckle made by molding the same from a synthetic plastic material.

BACKGROUND OF THE INVENTION

As described within Italian Patent No. 1,097,695 of Illinios Tool Works Inc, entitled "BUCKLE", the necessary parts of which are incorporated herein by reference, there is disclosed a buckle comprising a male part having a device for gripping a strip or sheet material, such as, for example, a belt or braces, and a base shoulder from which project a pair of resilient lateral arms and a rigid central arm, the arms together forming an E-shape configuration. The buckle further includes a female part defined by means of a box-like body, having a frontal opening and a pair of lateral through slots defining within it a housing socket for receiving the male part. The female part is also usually provided with a device or component portion for gripping strip or sheet material, and is also usually further provided with guide means which, during the connecting operation defined between the male and female parts of the buckle, cooperate with the rigid central arm of the male part for guiding the movement thereof and, once the connection has been achieved, which takes place by means of the snap-engagement of respective teeth or projections carried upon the resilient arms of the male part respective with the slots of the female part, limit the possible displacement of the male part to movement within a single plane and further act to reinforce the central arm of the male part by providing it with a continuous abutment in such a way that this latter component is, in use, adapted to limit any possible deflection of the resilient arms of the male part inwardly with respect to the female part, such as, for example due to the transmission to the buckle of torsional forces, and thus avoids accidental release of the buckle.

Buckles of the type described operate very well and have a considerable ease of use. However, as has been noted particularly in recent times, the requirement has arisen for making the release of the buckle particularly rapid. Furthermore, buckles of the type described have a coupling position established by means of the cooperation of the base shoulder of the male part with the mouth of the socket of the female part. In order to allow connection and release of the buckle, this position must be established in such a way as to leave a small axial clearance for the teeth or projections of the male part disposed within the slots of the female part so that, under particularly loaded and unstable conditions, such as for example buckles used for harnesses for sporting activities (surfing, sailing, or the like) and/or for helmets, a predetermined amount of wear of the connecting parts arises or develops after a predetermined period of use.

OBJECT OF THE INVENTION

The object of the present invention is to provide a releasable two-part buckle made of plastic material, and of the known type as described in Italian Patent No. 1097695, in which the release of the buckle will be extremely rapid and in which, under normal conditions of use, it will be possible to minimize and/or eliminate the clearance defined between the elements connecting the male and female parts together.

SUMMARY OF THE INVENTION

The foregoing and other objects are achieved by means of the present invention, which relates to a releasable two-part buckle comprising a female part, and a male part adapted to cooperate with the female part so as to assume with respect thereto a connection position in which the male part snap-engages into a socket defined within the female part, characterized by the fact that one of the male and female parts is provided, at a first shoulder element disposed orthogonally with respect to the direction of introduction of the male part into the female part with resilient means adapted, at the connection position, to cooperate in an interfering manner with a corresponding second shoulder element disposed parallel to the first shoulder element and carried by means of the other one of the male and female parts.

BRIEF DESCRIPTION OF THE DRAWINGS

For a better understanding of the present invention a preferred embodiment will be described hereinafter purely by way of non-limitative example and with reference to the attached drawings, in which like or corresponding parts of the invention are designated by means of the same or corresponding reference characters throughout the several views, and wherein.

DETAILED DESCRIPTION OF THE INVENTION

Figure 1:
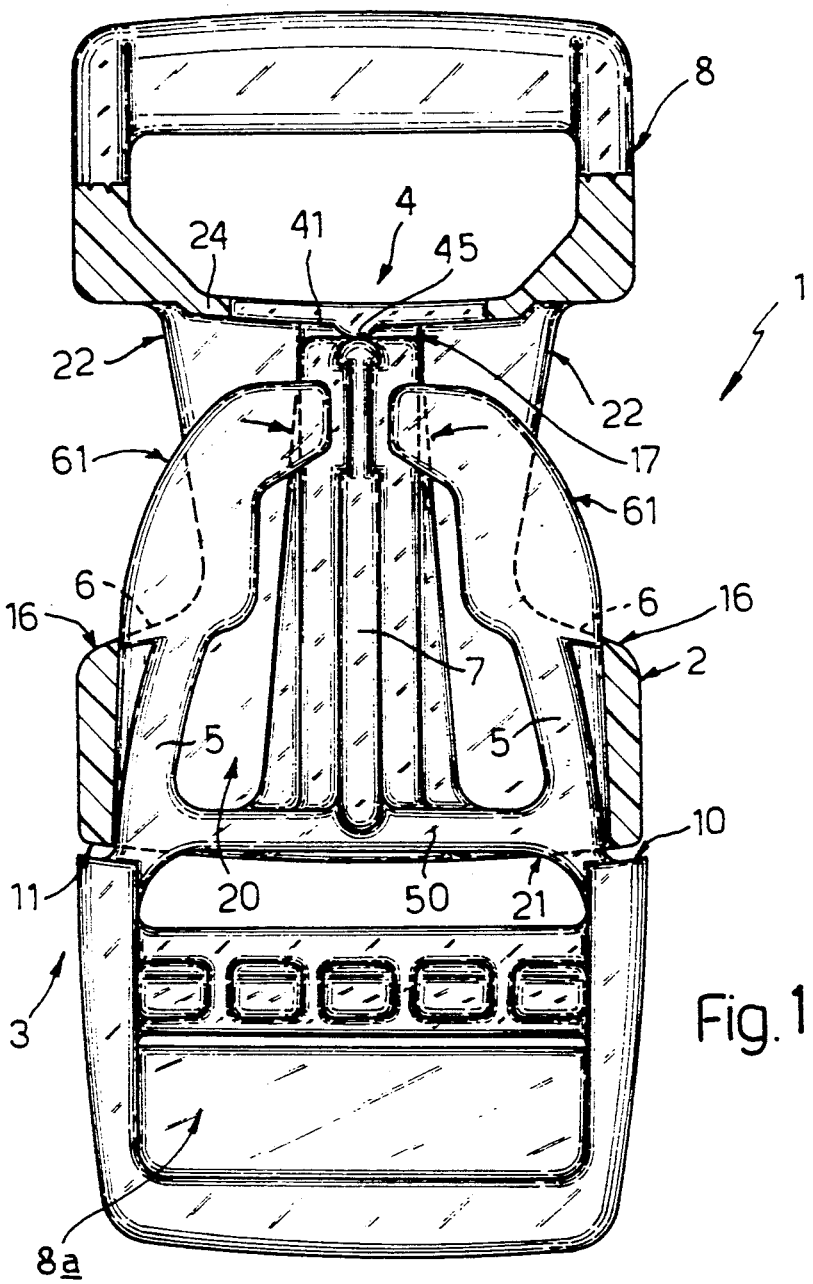
FIG. 1 is a partially sectioned plan view of a buckle constructed according to the present invention and shown during the initial connection phase when locking has not yet been achieved.
Figure 2:
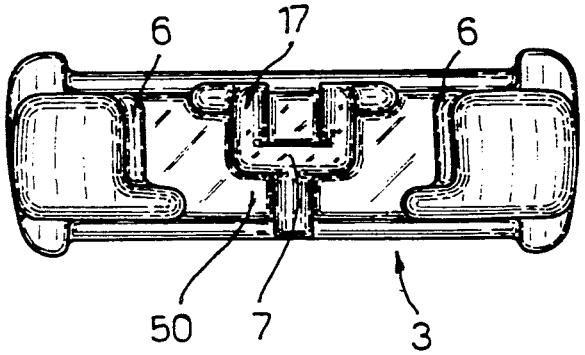
FIG. 2 is a front view of the male part of the buckle of FIG. 1 as seen from the end which is introduced into the female part of the buckle.
Figure 3:
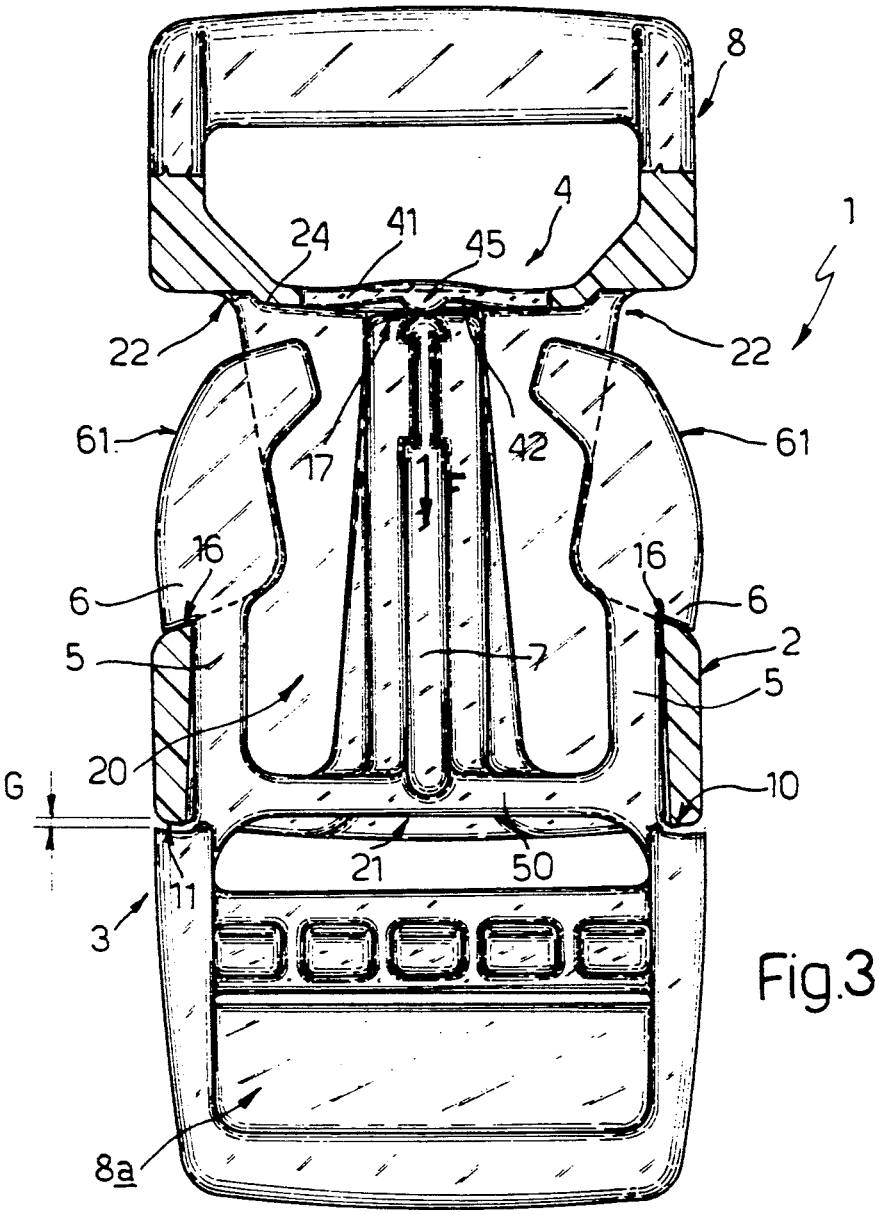
FIG. 3 is a plan view of the buckle of FIG. 1 in the connection position, with the male part completely introduced into and fully engaged with the female part.

As shown in FIG. 1, a two-part releasable buckle, generally indicated by means of the reference numeral 1, is made by molding the same from a synthetic plastic material and comprises a female part or element 2 and a male part or element 3 adapted to cooperate in use with the female part 2 (FIG. 1) so as to assume, with respect to the female part, a connection position, shown in FIG. 3, in which the male part 3 is snap-engaged into a socket 20 defined within the female part 2; the buckle 1 serves to join strips of material such as, for example, belts, straps, braces, and the like, which are known and not illustrated for simplicity, in a releasable manner. For this purpose both the male part 3 and the female part 2 are provided with respective known coupling means indicated by means of the reference characters 8 and **8*a***, the second of which also allows continuous adjustment of the length of the straps or strips when engaged in use, in a known way not illustrated for simplicity.

Figure 4:
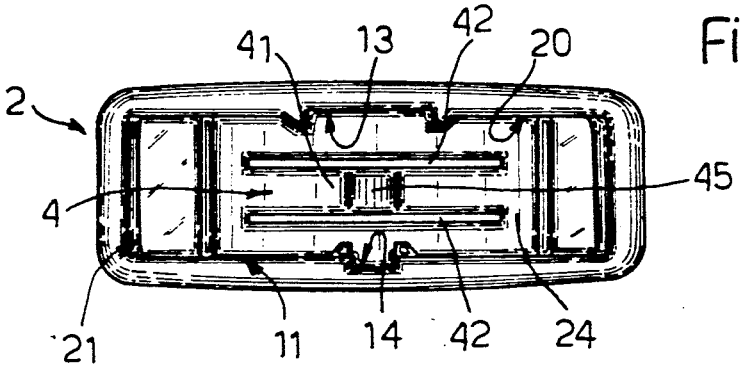
FIG. 4 is a front view of the female part of the buckle of FIG. 1 as viewed from the side into which the male part is introduced.
Figure 5:
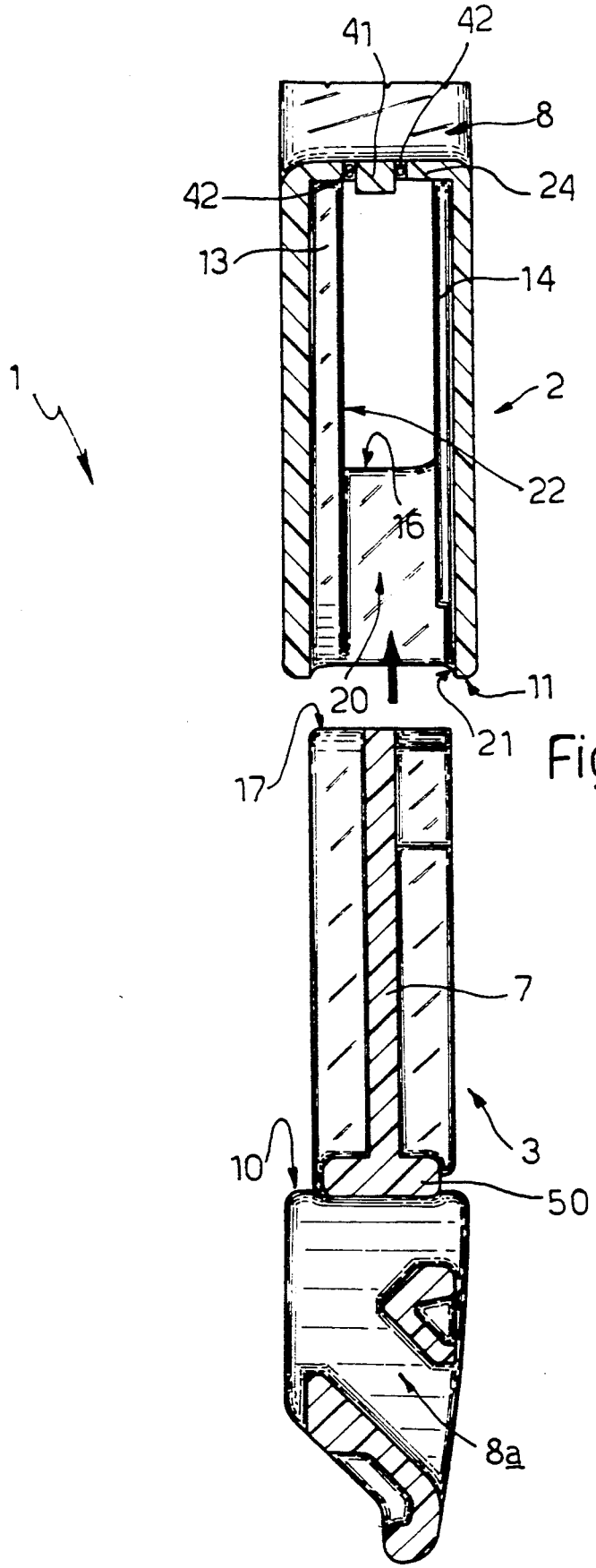
FIG. 5 is a sectioned side view taken on a longitudinal plane through the buckle of FIG. 1 with the buckle shown in the released position.

In the specific example illustrated which is shaped like the buckle described in the previously mentioned Italian Patent No. 1097695 the necessary parts of which are incorporated herein by reference, the female part 2 is defined by means of a box-like body of substantially parallelepiped form provided internally with a socket 20 and with a frontal aperture 21 by means of which the male part 3 can be introduced into the socket 20, and with a pair of oppositely disposed longitudinally extending lateral through slots 22, formed in a perpendicular sense with respect to the aperture 21, that is, parallel to the direction of introduction of the male part 3 into the female part 2, as indicated by means of the arrow in FIG. 5. The male part 3 is, on the other hand, substantially E-shape in plan view (FIGS. 1 and 3) and comprises a pair of resiliently deformable longitudinally extending lateral arms 5 which are symmetrical with respect to one another, and which are provided with teeth or projections 6 which in use lock the male part 3 within the female part 2 by cooperating, at the connected position (FIG. 3) with respective edges 16 of the slots 22, and a third, substantially rigid arm 7 which is disposed between the resilient lateral arms 5 and which, in use, from the commencement of the connecting operation and, subsequently, during (FIG. 1) and after (FIG. 3) the fully engaged connection thereof, cooperates with respective guide means provided within the socket 20 in such a way as to provide a continuous support for the rigid arm 7 so that the rigid arm 7 is able to limit the laterally inward deflection of the resilient arms 5, in the direction of the arrows (as shown in FIG. 1), both when the elements 2, 3 are not connected and, above all, when the elements 2, 3 are connected. These guide means are constituted in the specific embodiment by means of a pair of oppositely disposed longitudinal grooves 13, 14 formed upon upper and lower internal wall portions of the socket 20 over the entire length thereof and parallel to the direction of introduction of the male part 3 into the female part 2, which are best shown in FIG. 4 and which are shaped in such a way as to be able to receive the opposite upper and lower longitudinal edges or surface portions of the arm 7 in a slidable manner and without substantial play.

According to the invention, one of the male and female parts is provided, at a first shoulder element disposed orthogonally with respect to the direction of introduction of the male part into the female part, with resilient means generally indicated by means of the reference character 4, which is operable, at the connected position of FIG. 3, to cooperate in an interfering manner with a corresponding second shoulder element disposed parallel to the first element and carried by means of the other one of the male and female parts. In the specific example of the present invention, the resilient means 4 is carried by means of the bottom wall 24 of the socket 20 (and therefore constitutes the first shoulder element) and is disposed parallel to and faces the opposite end of the aperture 21. This resilient means 4 comprises a resiliently deformable leaf spring element 41 (illustrated in the undeformed position in FIG. 1 and in the deformed position in FIG. 3) which is defined by means of a portion of the bottom wall 24 delimited between two transverse through slots 42 which are parallel to one another and which are formed through or within the bottom wall 24 of the socket 20 so as to extend orthogonally with respect to the direction of introduction of the male part 3 into the female part 2.

The second shoulder element is, on the other hand, defined by means of a frontal end portion 17 of the central rigid arm 7. This arm, according to the present invention, is in fact made in such a way so as to have a length such that the end 17 cooperates in an interfering manner with the resilient means 4, producing resilient deformation and associated generation of a reaction force, when the teeth or projections are located at the connection position within the slots 22. In particular, the rigid central arm 7 has a greater length than the internal depth of the socket 20 as measured in the direction of introduction of the male part into the female part between the mouth 21 and the portion of the bottom wall 24 defining the leaf spring 41. Preferably, the leaf spring 41 is provided, at the middle, facing towards the mouth 21 portion thereof and with a transverse projection 45. In this manner, the end 17 of the rigid arm 7 can be brought into contact with the projection 45 during the closure and again slightly after the snap-engagement of the teeth or projections 6 into the slots 22, with consequent engagement with the edges 16 of the female part 2 (FIG. 1).

The engaged position of the teeth or projections 6 is also defined by means of transverse shoulder 10 of the male part 3, and in the specific example of the present invention, such is defined by means of a front edge of a base crosspiece 50 from which the arms 5 and 7 project, the shoulders 10 being adapted to cooperate by means of abutment against a corresponding transverse shoulder of the female part 2 defined by means of a frontal perimetral edge 11 of the opening 21. The engagement devices 8, **8*a* for the strips of sheet-like material to be joined by means of the buckle 1 are in the specific example of the present invention formed integrally in one piece with the parts 2 and 3, and in particular are in correspondence with the bottom wall 24 and the crosspiece 50** respectively.

The operation of the buckle 1 as has been described above is as follows: in order to engage the buckle, the elements 2 and 3 are arranged, uncoupled, as shown in FIG. 5, with the arm 7 aligned with the grooves 13, 14, and the male part 3 is then pushed into the socket 20 in the direction of the arrow (FIG. 5). If the two parts are not properly aligned the introduction of the male part into the female part will not take place immediately in that the arm 7 interferes with or encounters the edge 11. This results, however, in the development of a self-centering effect due to the particular rounded shape of the edge 11 and the tapered shape of the arm 7 which together facilitate the entrance of the arm 7 into the socket 20. When the parts 2, 3 are properly aligned, the arm 7 engages the grooves 13, 14 thereby holding the parts 2, 3, from this moment on, rigorously aligned and guided with respect to one another for the entire remainder of the connecting operation and even subsequently thereto once the connection has taken place. With the thrust upon the male part 3 continuing, the arms 5, which are shorter than the arms 7, enter into cooperation with the edge 11 of the opening 21, that is in particular the rounded frontal end parts 61 which join with the teeth 6, which are displaced rearwardly towards the beam 50 with respect to the end parts 61, engage the frontal edge opening 11. The form of each part 61 causes the the generation of a deflection component to be impressed upon the arms 5, which causes resilient deflection thereof towards the central arm 7 in the direction of the arrows (FIG. 1), which permits the introduction of the male part 3 into the socket of the female part 20 through means of the opening 21.

The movement of the male part 3 into the socket 20 continues until it reaches the position of FIG. 1 at which time the end 17 comes into contact with the projection 45 of the leaf spring portion 41. At this position the parts 61 are by now substantially aligned with the slots 22 but the arms 5 are still held in their deflected position by means of the fact that the teeth 6 have not yet passed the edges 16 and therefore as a result of the engagement of the portions 61 with the internal side walls of the socket 20, the arms 5 are not permitted to deflect back toward their original positions. With further movement of the male part 3 into the socket 20 the shoulder 10 of the male part is moved into contact with the edge 11 of the female part and the leaf spring 41 deforms by flexing towards the exterior of the socket 20 thus generating a reaction load F against the arm 7 as seen in FIG. 3. In the meantime, the teeth 6 of the male part pass the edges 16 of the female part and the resilient arms 5, no longer held deflected by means of the internal side walls of the socket 20, return to their original undeflected positions causing introduction of the teeth 6 into the slots 22 beyond the edges 16 thereof with a clearance G equal to an amount which is strictly necessary to allow connection.

Meanwhile, the load F is transmitted through means of the rigid arm 7 to the entire male part or element 3, which is thrust rearwardly so as to cause engagement without play of the teeth 6 against the edges 16 (FIG. 3). Under these conditions the buckle is connected in an excellent manner in that the axial clearance G necessary to allow the snap-engagement of the teeth 6 into the slots 22 is transferred or converted into a displacement defined by means of an equal amount between the shoulders 10, 11 (FIG. 3), the teeth 6 thereby being held in engagement against the edges 16 by means of the resilient reaction F generated by means of the leaf spring 41. In order to open the buckle 1 and cause rapid disengagement of the element 3 from the element 2 it is sufficient to exert through means of the slots 22 a pressure or force upon the parts 61 of the arms 5 which is directed inwardly with respect to the socket 20 in the direction of the arrows (FIG. 1). In view of the inclined form of the teeth 6 this lateral thrust frees them from engagement with the edges 16, against the action of the resilient arms 5, thus allowing the user to disengage the teeth 6 from the slots 22. At this point, the resilient thrust exerted by the means 4, or rather by means of the leaf spring 41, causes ejection of the male part from the socket 20, which ejection takes place without the possibility of any obstruction due to the guiding action of the arm 7 and the grooves 13, 14 and with great rapidity due to the fact that the leaf spring 41 is pre-loaded during the buckle closing stage.

From what has been described herein above the advantages associated with the present invention are evident, due to the presence of the resilient means upon the bottom of the socket within the female part, which transmits an axial reaction force to the rigid arm of the male part, whereby there is guaranteed, on the one hand an effective locking of the male part within the female part, eliminating the problems of wear connected with the presence of the insertion clearances between the teeth 6 and the edges 16, and wherein further the deliberate release of the buckle by means of the user is rendered completely automatic in that the ejection of the male part is achieved entirely by relying upon the aforenoted reaction force. Similarly, involuntary release, for example due to torsional forces exerted within the plane within which the buckle lies, are (within the limits of mechanical strength of the materials used) otherwise impossible, as can occur in known buckles of the same type as that illustrated.

Obviously, many modifications and variations of the present invention are possible in light of the above teachings. It is therefore to be understood that within the scope of the appended claims, the present invention may be practiced otherwise than as specifically described herein.

What is claimed is:

1. A releasable two-part buckle, comprising:

a female component which comprises a socket including a pair of oppositely disposed sidewalls, each of said sidewalls including a slot means and a latching shoulder means; and an end wall having resilient means disposed thereon; and a male component for snap-engagement within said socket of said female component, said male component having a substantially E-shaped configuration comprising a pair of laterally outwardly disposed flexible arms having projecting teeth means disposed thereon, wherein said pair of laterally outwardly disposed flexible arms are provided for snap-engagement cooperation within said slot means of said sidewalls of said female component while said projecting teeth means snap-engage said latching shoulder means of said sidewalls of said female component when said male component is snap-engaged within said socket of said female component; and a central arm, interposed between said pair of laterally outwardly disposed flexible arms, for engaging said resilient means of said female component such that as a result of said engagement of said central arm of said male component with said resilient means of said female component, said projecting teeth means of said pair of laterally outwardly disposed flexible arms of said male component are biased into engagement with said latching shoulder means of said female component sidewalls so as to maintain said male and female components tightly but releasably engaged with respect to each other.

2. A buckle as set forth in claim 1, wherein:

said end wall of said female component, upon which said resilient means is disposed, is disposed substantially orthogonally with respect to the direction of insertion of said male component into said female component when said male component is desired to be snap-engaged within said female component.

3. A buckle as set forth in claim 2, wherein:

said laterally outwardly disposed flexible arms include arcuately curved engagement portions extending rearwardly from said projecting teeth means as viewed in said direction of insertion of said male component into said female component; and said female component further comprises second shoulder means, disposed forwardly of said latching shoulder means as viewed in said direction of insertion of said male component into said female component, for engaging said arcuately curved engagement portions of said laterally outwardly disposed flexible arms so as to bias said laterally outwardly disposed flexible arms laterally inwardly toward said central arm so as to permit insertion of said male component within said female component.

4. A buckle as set forth in claim 1, wherein:

said substantially E-shaped male component comprises a base portion from which said pair of laterally outwardly disposed flexible arms and said central arm extend; and the length of said central arm of said male component, as defined between said base portion and a free distal end portion of said central arm which engages said resilient means of said female component, is such that said free distal end portion of said central arm engages said resilient means of said female component when said projecting teeth means of said male component are fully engaged with said latching shoulder means of said female component whereby said resilient means biases said male component in a direction opposite to the direction of insertion of said male component into said female component so as to maintain said biased engagement of said projecting teeth means of said male component with said latching shoulder means of said female component.

5. A buckle as set forth in claim 4, wherein:

said female component socket further comprises an insertion opening, defined within a second end wall disposed opposite said end wall upon which said resilient means is disposed, for permitting insertion of said male component into said female component; and said length of said central arm of said male component is greater than the internal depth of said socket of said female component as defined between said insertion opening and said end wall upon which said resilient means is disposed such that when said male component is fully engaged within said female component, said resilient means of said female component is resiliently deformed from a first normal, non-flexed position to a second biasing flexed position at which said resilient means biases said male component in said direction opposite to said direction of insertion of said male component into said female component so as to bias said projecting teeth means of said male component into engagement with said latching shoulder means of said female component.

6. A buckle as set forth in claim 1, wherein:

said resilient means of said female component comprises a leaf spring incorporated within said end wall of said female component socket.

7. A buckle as set forth in claim 1, further comprising:

support means integrally formed with each one of said male and female components for permitting attachment of securing straps, to said male and female components, in connection with which said buckle is to be used.

8. A buckle as set forth in claim 7, wherein:

said substantially E-shaped male component comprises a base portion from which said pair of laterally outwardly disposed flexible arms and said central arm extend; and said support means of said male component comprises a support bar disposed transversely with respect to said direction of insertion of said male component into said female component and parallel to said base portion of said male component with a predetermined space defined between said support bar and said base portion along said direction of insertion so as to permit said attachment of one of said securing straps to said male component.

9. A buckle as set forth in claim 7, wherein:

said support means of said female component comprises a support bar disposed transversely with respect to said direction of insertion of said male component into said female component and parallel to said end wall, upon which said resilient means is disposed, with a predetermined space defined between said support bar and said end wall along said direction of insertion so as to permit said attachment of another one of said securing straps to said female component.

10. A buckle as set forth in claim 1, wherein:

said socket of said female component has the configuration of a parallelepiped which includes a second pair of oppositely disposed sidewalls; and groove means defined within said second pair of oppositely disposed sidewalls for guidingly engaging said central arm of said male component during insertion of said male component within said female component.

* * * * *